United States Patent [19]

Derrah

[11] Patent Number: 4,979,760

[45] Date of Patent: Dec. 25, 1990

[54] SOFT BOOT BINDING FOR SNOW BOARDS

[76] Inventor: Steven J. Derrah, 58 Kingston Ave., Newport, R.I. 02840

[21] Appl. No.: 456,568

[22] Filed: Dec. 26, 1989

[51] Int. Cl.[5] ..... A63C 5/04

[52] U.S. Cl. ..... 280/607; 36/120; 36/54; 280/633; 280/11.36; 280/14.2

[58] Field of Search ..... 36/117, 120, 122, 125, 36/54; 280/607, 623, 617, 618, 633, 11.36, 14.2

[56] References Cited

U.S. PATENT DOCUMENTS

| | | | |
|---|---|---|---|
| 3,404,900 | 10/1968 | Rippetow | 28/609 |
| 3,900,204 | 8/1975 | Weber | 280/607 |
| 4,305,603 | 12/1981 | Müller et al. | 280/14.2 X |
| 4,403,785 | 9/1983 | Hottel | 280/14.2 |
| 4,470,206 | 9/1984 | Annovi | 36/54 X |
| 4,772,041 | 9/1988 | Klasterman | 280/618 X |

*Primary Examiner*—David M. Mitchell
*Assistant Examiner*—Michael Mar
*Attorney, Agent, or Firm*—Barlow & Barlow, Ltd.

[57] ABSTRACT

A snowboard binding has a shoe base plate with side walls and is provided with a single restraining strap to which is attached an instep pad that has a sustantially rigid portion that normally extends from the toe area of a foot to the lower shinbone. The pad may be adjusted up and down and allows for movement of the foot of the user. The pad is also adapted to have its curvature changed to suit certain maneuvers.

5 Claims, 1 Drawing Sheet

SOFT BOOT BINDING FOR SNOW BOARDS

BACKGROUND OF THE INVENTION

Snowboards are generally illustrated in prior patents such as the Rippetoe patent, U.S. Pat. No. 3,404,900, and the Weber patent, U.S. Pat. No. 3,900,204. In these patents, the general overall configuration is well illustrated and in each case, these disclosures utilize something akin to a regular snow ski binding which can be generically referred to as a releasable binding.

As the sport has progressed, it is found to be undesirable to have the binding releasable. For full control, it is important that the user have his boots secured to the board. Generally, in snowboarding, the manner in which the board is controlled is by the weight placed on the board by one's feet and one can even bend the board at various curvatures as well as distributing the weight for maneuvers on snow.

In the prior art it has been common to have a three-point attachment for snowboard bindings; that is to say, there would be a toe strap and instep strap and a shin strap which is very confining and limits the amount of movement.

SUMMARY OF THE INVENTION

A snowboard binding is formed with a shoe base plate that has an upstanding heel portion of considerable height as heretofore constructed; the heel extension being preferably suitably padded. The shoe base plate is formed with an upstanding peripheral edge with an open toe portion so that a boot may be readily received therein and a single strap extends from a point forward of the heel on one side of the base to a point on the base plate opposite the first with an adjustable instep pad secured to the strap, the instep pad having a elongated form that would extend from the toe up to the instep and is suitably cushioned so as to lie against the boot in a comfortable fashion. In this way, the leg may move readily within the binding and is sufficiently free to permit tweaking and other movements with the foot partially out of the binding.

DETAILED DESCRIPTION OF THE PREFERRED EMBODIMENT

Figure 1:
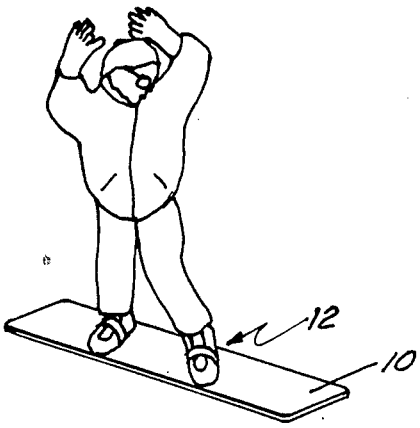
FIG. 1 is a perspective view of a snowboard binding and ski embodying the present invention illustrating a person in the normal use thereof.
Figure 2:
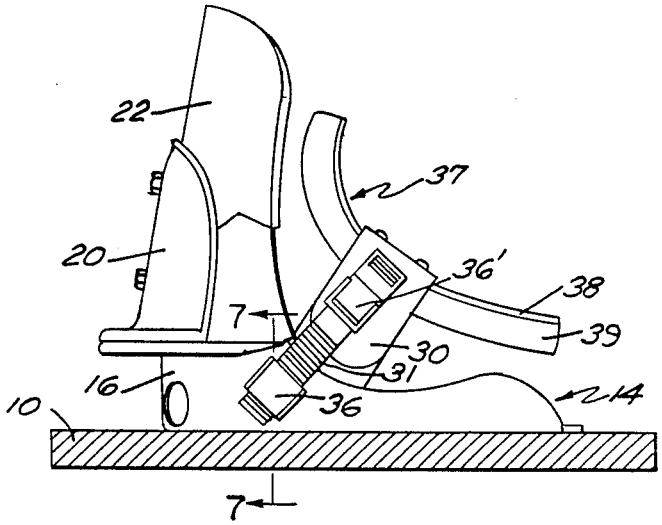
FIG. 2 is a side elevational view of the binding of the present invention.
Figure 7:
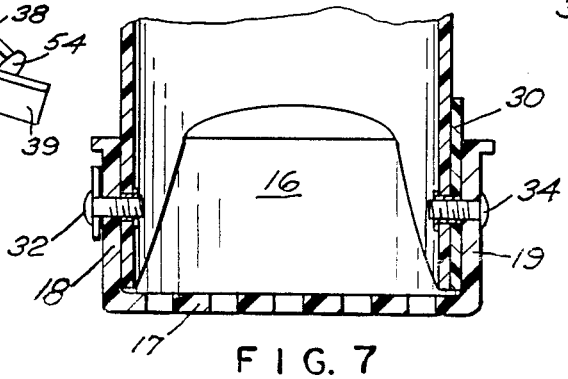
FIG. 7 is a sectional view taken on lines 7—7 of FIG. 2.

Referring now to the drawings and initially to FIG. 1, there is shown for illustrative purposes a ski 10 with a skier standing thereon in bindings 12 made in accordance with the present invention. The bindings 12, as seen in FIG. 2, comprise a shoe sole base plate generally indicated 14 which has an upstanding heel portion 16, a bottom plate 17 and upstanding side walls 18 and 19 that extend from the heel portion to the toe portion. Rising from the heel portion 16 is a rigid plate 20 to which is attached a calf cushion 22. To secure the boot in the binding a strap 30 extends from a point just forward of the heel where it is physically attached as by a rivet or screw fastener 34 (see FIG. 7) and thence comes over the instep where it is secured to the pad 37. For convenience of operation, the strap terminates short of the side wall 18 and a quick release strap extension 31 buckle 36' is attached to the end of the strap 30 and has a serrated strap that extends normally downward into an adjustable strap securing device 36 that is fastened to the side wall 18 as by a fastener 32. It will be seen, therefore, that the strap, including the release buckle and extension, extends between fasteners 32 and 34 and over the pad 37.

Figure 6:
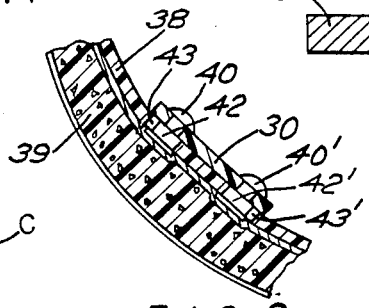
FIG. 6 is a sectional view taken on lines 6—6 of FIG. 5.

An instep pad generally indicated 37 is provided, and is constructed of essentially an upper, relatively stiff member 38 and a cushioning pad 39. As seen in FIG. 6, the strap 30 is affixed to the stiff portion 38 of the instep pad by screws 40, 40' and nuts 42, 42'. Preferably the rigid portion 38 is slotted as at 43, 43' so that the instep pad may be slid relative to the strap to procure a proper adjustment or location along the instep to suit and fit the user. Essentially the pad when in use normally extends from the toe area to the shinbone area. The pad, however, may be adjusted up and down from its normal position and in the up most position can be set for restraint tuning and in the down most position will provide a loose ankle fit in the binding.

Figure 8B:
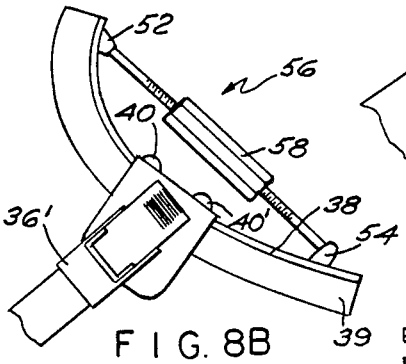
FIGS. 8A and 8B are illustrations of devices attached to the pad to vary the curvature thereof.
Figure 8A:
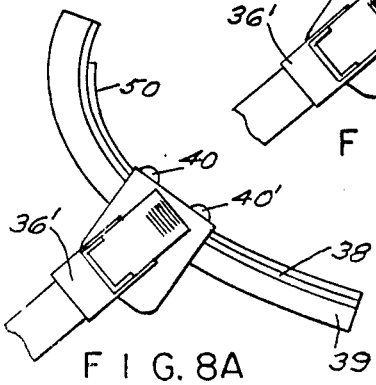

Referring to FIGS. 8A and 8B there is illustrated the use of a batten member 50 that is fixed to the upper surface of the to limit the flexure thereof for certain maneuvers. In FIG. 8B there is illustrated a pad with raised anchor points 52, 54 and between these points there is an adjustable turnbuckle generally indicated 56, that has a central portion with right and left handed threads so that extension or collapse may be perfected by rotating the central portion 58.

Figure 3:
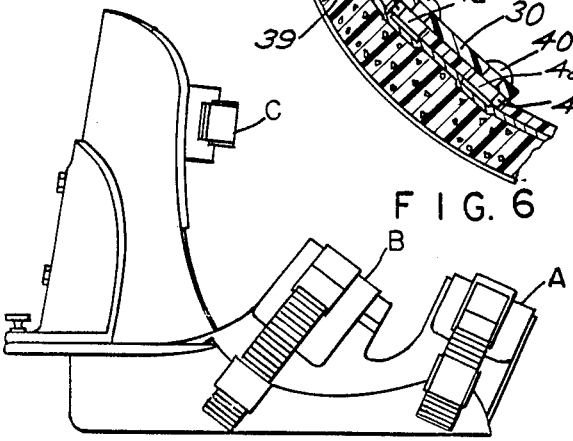
PRIOR ART FIG. 3
FIG. 3 is a side elevational view of the prior art.
Figure 5:
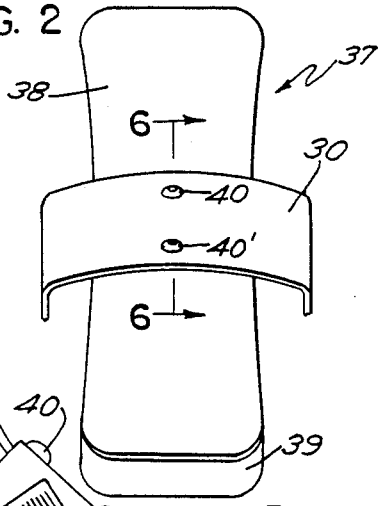
FIG. 5 is a plan view thereof; 15
Figure 4:
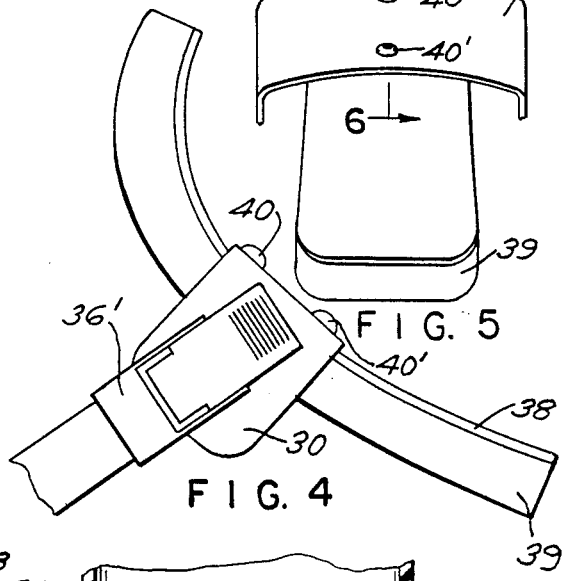
FIG. 4 is an enlarged side elevational view of the instep pad.

It will be apparent from the foregoing that the arrangement of the instant invention allows a boot to be inserted into the binding with a large degree of freedom as the toe is now inhibited from movement by the side walls 18, 19 and more particularly, the ankle and part of the lower leg are also restrained. If it is desirable to have more ankle movement the binding may be adjusted so that the pad 37 has less area at the ankle and more over the toe of the boot. The reverse is also true. In the prior art devices as seen in FIG. 3, there were three bindings, or straps, labeled A, B and C, each of which completely restrained the user's foot. Accordingly, with the use of the present invention, the skier may easily shift his weight transversely and longitudinally of the ski to provide the desired maneuverability and balance that is required for various maneuvers.

I claim:

1. A snowboard binding adapted to receive a user's boot, the binding including a shoe base plate and an upstanding heed and calf support, the base plate adapted to be fixedly secured to a snowboard, that improvement comprising a single strap member extending from a first point forwardly of the heel on one side of the base to a second point just forwardly of the heel on an opposite side of said base plate; an instep pad having a substantially rigid curved portion extending from the toe area to the lower shinbone of the user's boot and having a cushioned surface extending along a lower surface of said rigid curved portion, said strap member including first and second strap portions, said first strap portion extending across the upper portion of the user's boot and having a first end secured to said base plate at said first point and a second end which terminates short of said second point, said second strap portion having a first end pivotally secured to said base plate at said second point, said second ends of said first and second strap portions being releasably interconnected by means of a quick release buckle, and means for adjustably securing said rigid curved portion of said instep pad to said first strap portion at a central location along said rigid curved portion whereby the toe and leg portion are free to permit tweaking and other movements of the ankle and foot with varying degrees of restraint.

2. A snowbaord binding as in claim 1 wherein the shoe base plate has side walls that extend from the heel to the toe.

3. A snowboard binding as in claim 1 wherein said first strap portion has substantial width and strength to stabilize the instep pad.

4. A snowboard binding as in claim 1 wherein the instep pad may be vertically adjusted for restraint tuning or for providing a loose fit around the ankle.

5. A snowboard binding as in claim 1 wherein fine tuning of the binding is provided by a means extending from one end of the pad portion to the other which means may adjustably change the curvature of the pad.

* * * * *